US009487973B2

(12) United States Patent
Yokota

(10) Patent No.: US 9,487,973 B2
(45) Date of Patent: Nov. 8, 2016

(54) DOOR LATCH DEVICE

(71) Applicant: MITSUI KINZOKU ACT CORPORATION, Yokohama-shi, Kanagawa (JP)

(72) Inventor: Yoshiaki Yokota, Kanagawa (JP)

(73) Assignee: MITSUI KINZOKU ACT CORPORATION, Kanagawa (JP)

( * ) Notice: Subject to any disclaimer, the term of this patent is extended or adjusted under 35 U.S.C. 154(b) by 237 days.

(21) Appl. No.: 14/197,178

(22) Filed: Mar. 4, 2014

(65) Prior Publication Data

US 2014/0252783 A1 Sep. 11, 2014

(30) Foreign Application Priority Data

Mar. 6, 2013 (JP) ..... 2013-044568

(51) Int. Cl.

| | |
|---|---|
| ***E05C 3/06*** | (2006.01) |
| ***E05B 81/20*** | (2014.01) |
| ***E05B 81/34*** | (2014.01) |
| ***E05B 81/66*** | (2014.01) |
| ***E05B 81/68*** | (2014.01) |
| ***E05B 81/74*** | (2014.01) |
| *E05C 3/16* | (2006.01) |
| *E05B 81/06* | (2014.01) |

(52) U.S. Cl.

CPC ..... *E05B 81/20* (2013.01); *E05B 81/34* (2013.01); *E05B 81/66* (2013.01); *E05B 81/68* (2013.01); *E05B 81/74* (2013.01); *E05B 81/06* (2013.01); *Y10T 292/1076* (2015.04)

(58) Field of Classification Search

CPC ..... E05B 81/00; E05B 81/04; E05B 81/06; E05B 81/12; E05B 81/16; E05B 81/18; E05B 81/20; E05B 81/21; E05B 81/22; E05B 81/32; E05B 81/34; E05B 81/64; E05B 81/66; E05B 81/68; E05B 81/72; E05B 81/74; E05B 83/16; E05B 83/18

USPC ..... 292/201, 216, 196, 198, 223, DIG. 23, 292/DIG. 29, DIG. 42

See application file for complete search history.

(56) References Cited

U.S. PATENT DOCUMENTS 5,423,582 A * 6/1995 Kleefeldt ..... E05B 81/20 292/201
6,079,237 A * 6/2000 Hochart ..... E05B 81/14 292/201

(Continued)

FOREIGN PATENT DOCUMENTS

JP 2007-506879 A 3/2007
WO 2004/113655 A1 12/2004

OTHER PUBLICATIONS

Notification of Reasons for Refusal Japanese Patent Application No. 2013-044568 dated Jul. 26, 2016 with English language translation.

*Primary Examiner* — Alyson M Merlino
(74) *Attorney, Agent, or Firm* — McDermott Will & Emery LLP

(57) ABSTRACT

A linkage mechanism includes a first link rotatably supported on a fixed shaft, a second link rotatably supported on a latch shaft, and an intermediate link that is rotatably connected to the first link by a first link shaft and rotatably connected to the second link by a second link shaft. While the linkage mechanism moves a latch from a half-latch position into a full-latch position, the first link shaft moves in an area on one side of a plane serving as a boundary including a shaft center of the fixed shaft and a shaft center of the latch shaft, and the second link shaft moves in an area on the other side of the plane serving as the boundary.

6 Claims, 13 Drawing Sheets

(56) References Cited

U.S. PATENT DOCUMENTS 6,422,615 B1 * 7/2002 Roos ..... E05B 81/20 292/201
7,341,290 B2 * 3/2008 Torka ..... E05B 81/20 292/201
2002/0070564 A1 * 6/2002 Ohta ..... E05B 81/20 292/201
2003/0080569 A1 5/2003 Raymond et al.

* cited by examiner

DOOR LATCH DEVICE

CROSS REFERENCES TO RELATED APPLICATIONS

This application is based upon and claims the benefit of priority from Japanese Patent Application No. 2013-044568, filed on Mar. 6, 2013, the entire contents of which are incorporated herein by reference.

BACKGROUND OF THE INVENTION

1. Field of the Invention

The present invention relates to a door latch device.

2. Description of the Related Art

A door latch device that holds a door of a vehicle in a closed state includes a base plate having a striker entry groove entered by a striker, a latch rotatably supported on a latch shaft provided on the base plate, and a ratchet rotatably supported on a ratchet shaft provided on the base plate. The latch moves between a full-latch position in which the latch constrains the striker that has entered the striker entry groove by engaging with the striker, and an open position in which the latch releases the constrained striker. The ratchet moves between an engagement position in which the ratchet engages with the latch so as to hold the latch in the full-latch position, and a disengagement position in which the ratchet releases the engagement.

There are such kind of door latch devices (refer, for example, to Japanese Translation of PCT International Application Publication No. 2007-506879) that include a linkage mechanism that is operated by power from a driving member to move the latch to the full-latch position when the latch is moved from the open position into a half-latch position by, for example, a pressing load from the striker that has entered the striker entry groove.

The linkage mechanism includes a first link rotatably supported on a fixed shaft provided on the base plate, a second link rotatably supported on the latch shaft, and an intermediate link that is rotatably connected to the first link by a first link shaft and rotatably connected to the second link by a second link shaft. In the linkage mechanism, introducing the power from the driving member to the first link rotates the second link about the latch shaft so as to move the latch to the full-latch position.

In the door latch device disclosed in Japanese Translation of PCT International Application Publication No. 2007-506879, the first link, the second link, the intermediate link, and the driving member are arranged in an area on one side of a plane, serving as a boundary, including a shaft center of the fixed shaft and a shaft center of the latch shaft (hereinafter also called "boundary plane"). This necessitates a large space for arranging the linkage mechanism and the driving member on one area side of the boundary plane, and thus makes it difficult to reduce the size of the door latch device.

SUMMARY OF THE INVENTION

According to one aspect of the present invention, a door latch device includes: a base plate that has a portion defining a striker entry groove entered by a striker; a latch that is rotatably supported on a latch shaft provided on the base plate and that moves between a full-latch position in which the latch constrains the striker that has entered the striker entry groove by engaging with the striker, and an open position in which the latch releases the constrained striker; a ratchet that is rotatably supported on a ratchet shaft provided on the base plate and that moves between an engagement position in which the ratchet engages with the latch so as to hold the latch in the full-latch position, and a disengagement position in which the ratchet releases the engagement; and a linkage mechanism that is operated by power from a driving member to move the latch to the full-latch position when the latch moving from the open position toward the full-latch position reaches a half-latch position lying between the open position and the full-latch position, wherein the linkage mechanism comprises a first link that is rotatably supported on a fixed shaft provided on the base plate, a second link that is rotatably supported on the latch shaft, and an intermediate link that is rotatably connected to the first link by a first link shaft and rotatably connected to the second link by a second link shaft, and the linkage mechanism is configured such that, while the linkage mechanism moves the latch from the half-latch position into the full-latch position, the first link shaft moves in an area on one side of a plane serving as a boundary including a shaft center of the fixed shaft and a shaft center of the latch shaft, and the second link shaft moves in an area on the other side of the plane serving as the boundary.

The above and other features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENT

Figure 1:
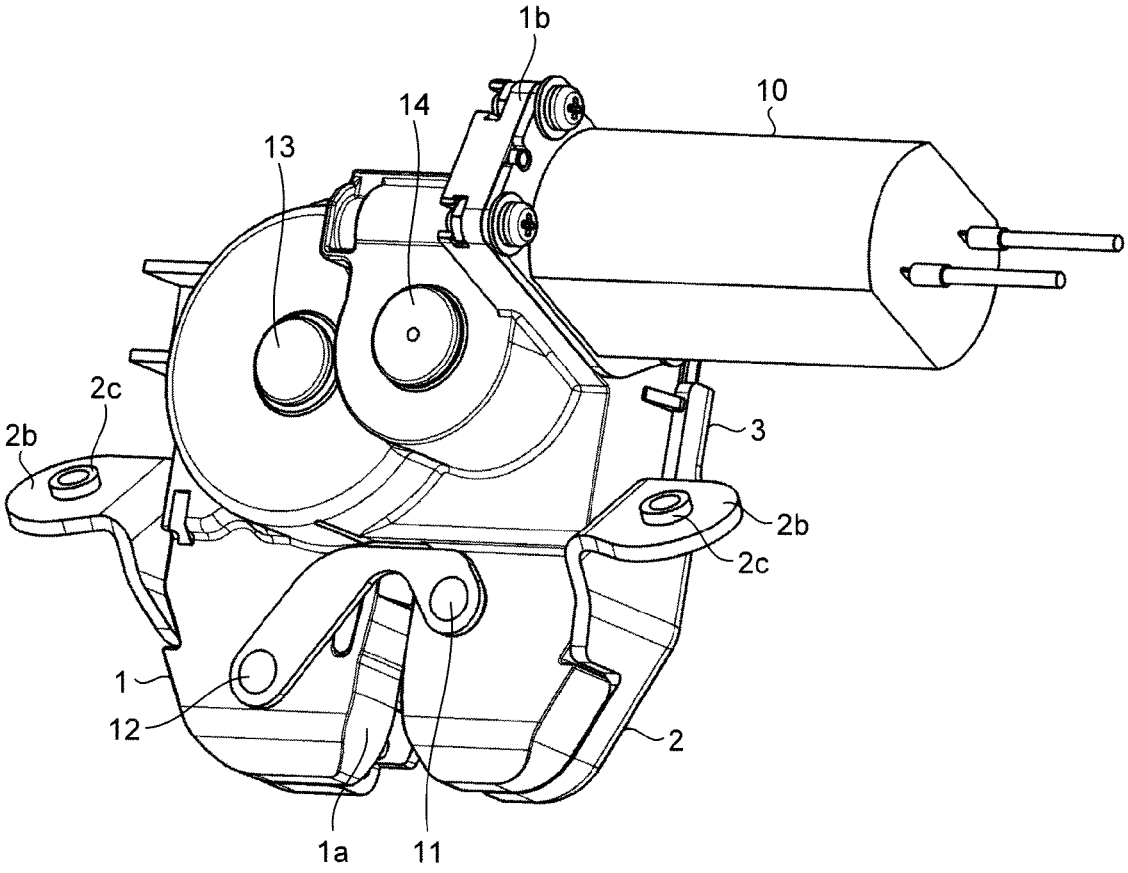
FIG. 1 is a perspective view of a door latch device serving as an embodiment of the present invention.

An embodiment of a door latch device according to the present invention will be described below in detail with reference to the accompanying drawings. In all of the drawings for explaining the embodiment, components having the same functions will be given the same reference numerals, and repetition of description thereof will be omitted.

Figure 2:
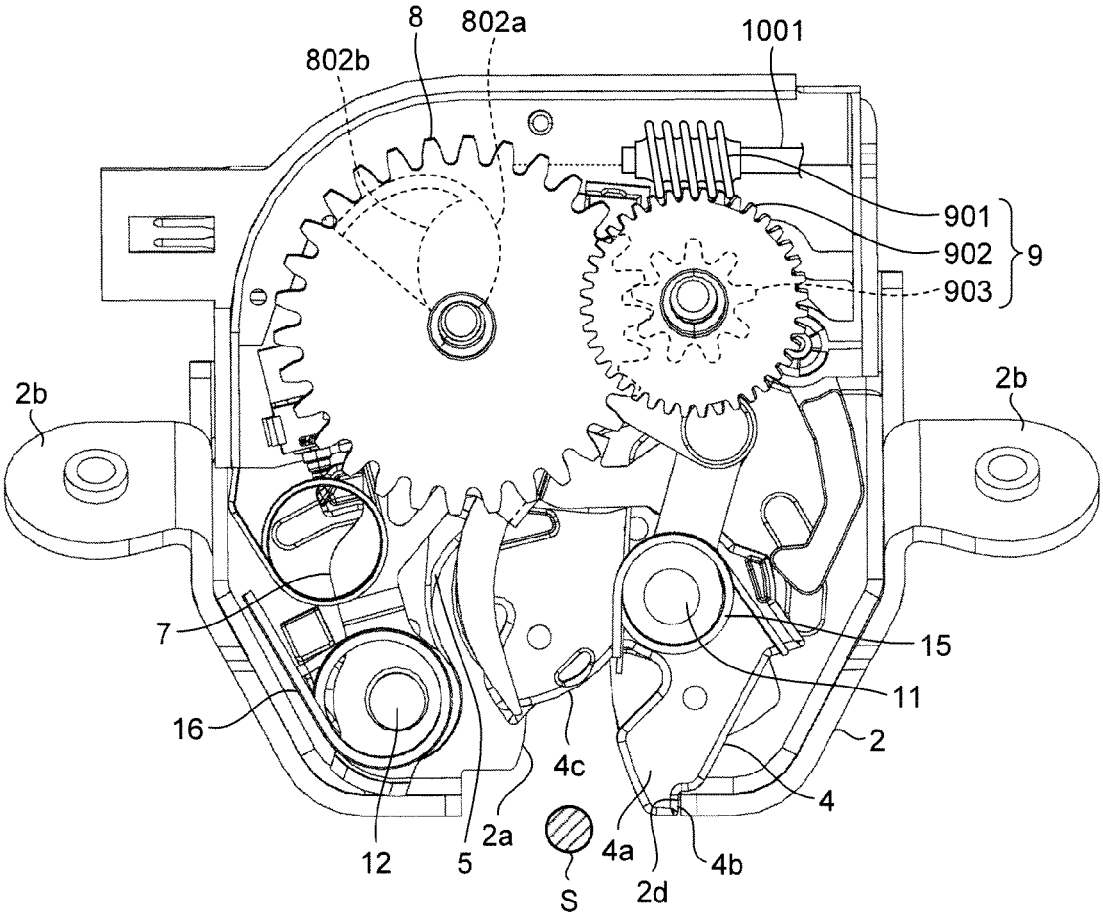
FIG. 2 is a plan view illustrating an internal configuration of the door latch device of FIG. 1.
Figure 3:
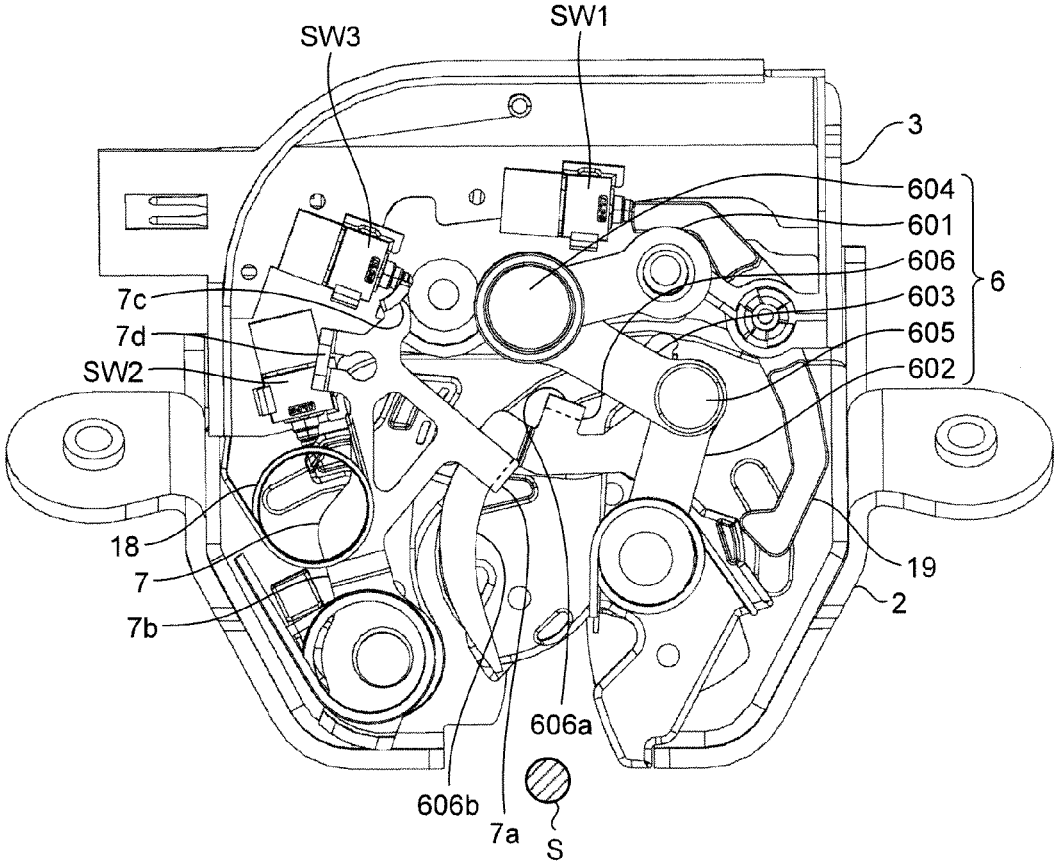
FIG. 3 is a plan view obtained by omitting a reduction gear and a cam gear from the view illustrated in FIG. 2.
Figure 4:
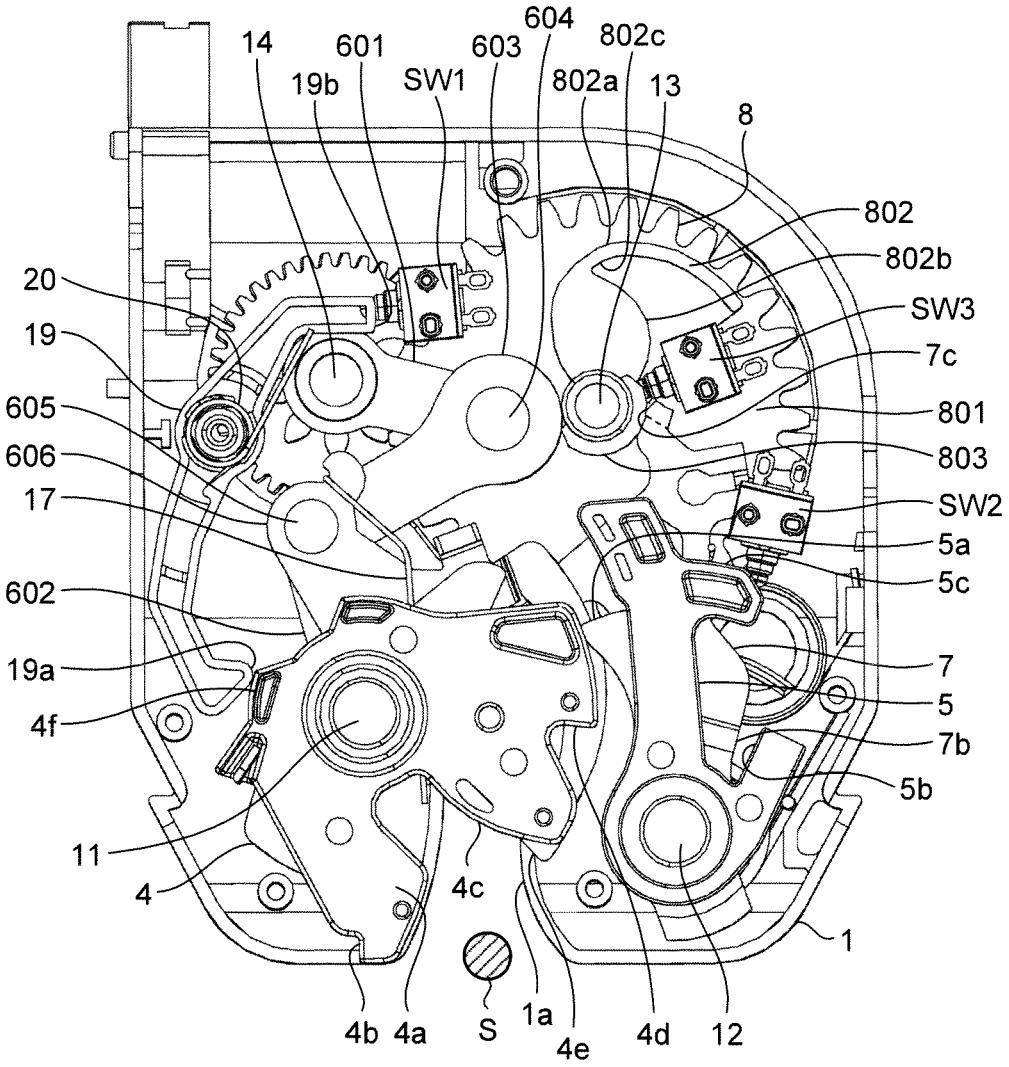
FIG. 4 is a view, as viewed from the backside, of the internal configuration illustrated in FIG. 2.
Figure 5:
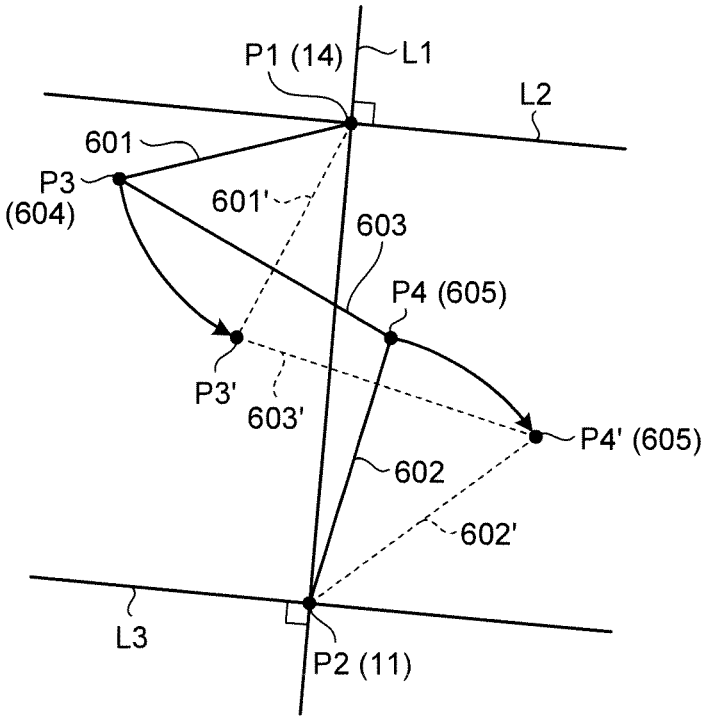
FIG. 5 is an operational schematic diagram of a linkage mechanism in the door latch device of the embodiment.

FIG. 1 is a perspective view of the door latch device serving as the embodiment of the present invention. FIG. 2 is a plan view illustrating an internal configuration of the door latch device of FIG. 1. FIG. 3 is a plan view obtained by omitting a reduction gear and a cam gear from the view illustrated in FIG. 2. FIG. 4 is a view, as viewed from the backside, of the internal configuration illustrated in FIG. 2. FIG. 5 is an operational schematic diagram of a linkage mechanism in the door latch device of the present embodiment.

The door latch device of the present embodiment is mounted on a back door of a vehicle, and holds the back door in a closed state by constraining a striker provided on a vehicle body. As illustrated in FIGS. 1 to 4, the door latch device includes, for example, a case 1, a base plate 2, a switch plate 3, a latch 4, a ratchet 5, a linkage mechanism 6, a lever ratchet 7, a cam gear (driving member) 8, a worm gear 9, and a motor 10.

The case 1, the base plate 2, and the switch plate 3 are members that house such components as the latch 4 and the ratchet 5.

The case 1 is provided with a striker entry groove 1*a* entered by a striker S, an insertion hole into which one end of a latch shaft 11 is inserted, an insertion hole into which one end of a ratchet shaft 12 is inserted, an insertion hole into which one end of a support shaft (revolution shaft) 13 supporting the cam gear 8 is inserted, an insertion hole into which one end of a support shaft (fixed shaft) 14 supporting a worm wheel 902 of the worm gear 9 is inserted, and a motor fixing portion 1*b* for fixing the motor 10, for example.

The base plate 2 is provided with a striker entry groove 2*a* entered by the striker S, an insertion hole into which the other end of the latch shaft 11 is inserted, an insertion hole into which the other end of the ratchet shaft 12 is inserted, insertion holes into which the other ends of the support shafts 13 and 14 are inserted, and mounting portions 2*b* for mounting the door latch device on the back door, for example. The mounting portions 2*b* are provided with insertion holes into which bolts are inserted. Barred portions 2*c* are provided around the insertion holes.

The switch plate 3 is provided with a first switch SW1 that detects a position of the latch 4, a second switch SW2 that detects a position of the ratchet 5, a third switch SW3 that detects a position of the cam gear 8, and wires connected to the switches SW1 to SW3, for example. The wires connected to the switches SW1 to SW3 are connected to a control board via a cable. Each of the first, the second, and the third switches SW1, SW2, and SW3 is what is called a microswitch, and is turned on when a plunger (not illustrated) is pressed.

The latch 4 is rotatably supported on the latch shaft 11, and urged counterclockwise in FIGS. 2 and 3 (clockwise in FIG. 4) by a latch spring 15. When the latch 4 is not constraining the striker S, the latch 4 is held in an open position, in which an abutting portion 4*b* provided at a tip of a striker constraining portion 4*a* abuts on a latch abutting portion 2*d* of the base plate 2. When the striker S enters the striker entry grooves 1*a* and 2*a* while the latch 4 is in the open position, the striker S presses a pressure receiving portion 4*c* of the latch 4. Having received a pressing load from the striker S, the latch 4 rotates counterclockwise in FIG. 4, and moves toward a full-latch position in which the latch 4 constrains the striker S.

The ratchet 5 is rotatably supported on the ratchet shaft 12, and urged clockwise in FIGS. 2 and 3 (counterclockwise in FIG. 4) by a ratchet spring 16. The ratchet 5 is provided with a latch engagement portion 5*a* that engages with the latch 4 so as to hold the latch 4 that has rotated counterclockwise in FIG. 4 in a half-latch position or the full-latch position. Engagement of the latch engagement portion 5*a* with a half-latch latching portion 4*d* provided on the latch 4 holds the latch 4 in the half-latch position. Engagement of the latch engagement portion 5*a* with a full-latch latching portion 4*e* provided on the latch 4 holds the latch 4 in the full-latch position. Rotating the ratchet 5 clockwise in FIG. 4 releases the engagement between the latch engagement portion 5*a* and the latch 4, and thus moves the latch 4 into the open position.

The linkage mechanism 6 operates so as to move the latch 4 that has moved from the open position into the half-latch position further into the full-latch position, and includes a first link 601, a second link 602, an intermediate link 603, a first link shaft 604, a second link shaft 605, and a retraction lever 606. The first link 601 is rotatably supported on the support shaft (fixed shaft) 14 provided on the base plate 2. The second link 602 is rotatably supported on the latch shaft 11. The intermediate link 603 is rotatably connected to the first link 601 by the first link shaft 604, and rotatably connected to the second link 602 by the second link shaft 605.

The first link 601, the second link 602, and the intermediate link 603 are arranged in a Z-shape so that, as illustrated in FIG. 5, a shaft center P3 of the first link shaft 604 is positioned in an area on one side of a first plane L1 serving as a boundary including a shaft center P1 of the support shaft 14 and a shaft center P2 of the latch shaft 11 (hereinafter also called "first area"), and a shaft center P4 of the second link shaft 605 is positioned in an area on the other side of the first plane L1 serving as the boundary (hereinafter also called "second area"). The support shaft 14 and the latch shaft 11 have actually cylindrical shapes, and the shaft center P1 of the support shaft 14 and the shaft center P2 of the latch shaft 11 are line segments having lengths of the cylinders. This allows the first plane L1 to be defined by three points, including two different points on the shaft center P1 of the support shaft 14 and one point on the shaft center P2 of the latch shaft 11.

The first link 601, the second link 602, and the intermediate link 603 are further arranged so that the ratchet 5 is included in the first area bounded by the first plane L1. Specifically, the first area serves as an area on the side including the ratchet 5 with respect to the first plane L1 serving as the boundary, and the first link shaft 604 is arranged in the first area.

The lengths of the first link 601, the second link 602, and the intermediate link 603 are set so that a movement of the first link 601 into a position of a dashed line 601' by rotating counterclockwise in FIG. 5 rotates the second link 602 clockwise in FIG. 5 to move it into a position of a dashed line 602', and, at that time, an amount of movement (from P4 to P4') of the shaft center P4 of the second link shaft 605 results in an amount necessary for moving the latch 4 from the half-latch position into the full-latch position.

The lengths of the first link 601, the second link 602, and the intermediate link 603 are further set so that, while the latch 4 is moved from the half-latch position into the full-latch position, the shaft center P3 of the first link shaft 604 and the shaft center P4 of the second link shaft 605 move in an area interposed between a second plane L2 and a third plane L3 illustrated in FIG. 5. The second plane L2 is a plane including the shaft center P1 of the support shaft 14 and orthogonal to the first plane L1. The third plane L3 is a plane including the shaft center P2 of the latch shaft 11 and orthogonal to the first plane L1.

The retraction lever 606 is engaged with the latch 4 when the latch 4 is moved from the half-latch position into the full-latch position, and is rotatably connected to the second link shaft 605. The retraction lever 606 extends from the second link shaft 605 and intersects the first plane L1 into the first area, and the extending portion thereof is provided with a retraction portion 606*a* and a cancel portion 606*b*. The retraction portion 606*a* is a portion that engages with a retraction engagement portion 4*g* of the latch 4 when the latch 4 has moved from the open position into the half-latch position. The cancel portion 606*b* is a portion that engages with the lever ratchet 7 and receives a pressing load from the lever ratchet 7 when the engagement between the retraction portion 606*a* and the latch 4 is released. The cancel portion 606*b* is provided at a tip of a portion extending from the second link shaft 605 so as to form a circular arc around the shaft center of the latch shaft 11 so that the retraction lever 606 can rotate about the latch shaft 11 together with the second link 602.

The retraction lever 606 is urged counterclockwise in FIGS. 2 and 3 (clockwise in FIG. 4) by a coil spring (linkage mechanism urging spring) 17. Specifically, the retraction lever 606 is urged by the coil spring 17 so that the direction of urging the rotation thereof about the second link shaft 605 is the same as the direction of urging the rotation of the latch 4 about the latch shaft 11. The retraction portion 606*a* of the retraction lever 606 is placed in a position that is moved closer to the latch shaft 11 by the rotation of the retraction lever 606 in the urged direction thereof. The retraction lever 606 is held in a position in which, as illustrated in FIGS. 3 and 4, the retraction portion 606*a* can be separated from the latch 4 by engagement of a root portion of the cancel portion 606*b* with a retraction lever pressing portion 7*a* of the lever ratchet 7 while the latch 4 is in the open position, and can engage with the retraction engagement portion 4*g* of the latch 4 when the latch 4 moves into the half-latch position.

The lever ratchet 7 releases the engagement between the retraction portion 606*a* of the retraction lever 606 and the latch 4, and the engagement between the latch 4 and the ratchet 5, and is rotatably supported on the ratchet shaft 12. The lever ratchet 7 is provided with the retraction lever pressing portion 7*a*, a ratchet pressing portion 7*b*, a cam sliding contact portion 7*c*, and a cable connection portion 7*d*. The retraction lever pressing portion 7*a* is a portion that engages with the cancel portion 606*b* of the retraction lever 606, and presses the cancel portion 606*b* in the direction of moving the retraction portion 606*a* away from the latch 4 to rotate the retraction lever 606 about the second link shaft 605. The ratchet pressing portion 7*b* is a portion that presses a pressure receiving portion 5*b* of the ratchet 5 so as to move the ratchet 5 into a disengagement position. The cam sliding contact portion 7*c* is a portion that slidingly contacts a cam portion 802 of the cam gear 8 and receives a pressing force from the cam portion 802 on the occasion of releasing the engagement between the latch 4 and the ratchet 5. The cable connection portion 7*d* is a portion that connects a cable extending from a control lever for manual disengagement in the case of allowing the engagement between the latch 4 and the ratchet 5 to be released manually. The lever ratchet 7 is urged clockwise in FIGS. 2 and 3 (counterclockwise in FIG. 4) by a coil spring (lever ratchet urging spring) 18.

The cam gear 8 outputs power of the motor 10 transmitted via the worm gear 9 to the linkage mechanism 6 and the lever ratchet 7, and is rotatably supported on the support shaft (revolution shaft) 13. The cam gear 8 is provided with a gear portion 801, the cam portion 802, and a switching portion 803. The gear portion 801 meshes with a reduction gear portion 903 provided on the worm wheel 902. The cam portion 802 is a portion that revolves about the support shaft 13 as a result of rotation of the gear portion 801, and includes a first cam surface 802*a* that presses the first link shaft 604 and the lever ratchet 7 when the cam portion 802 revolves in the counterclockwise direction in FIG. 4 (hereinafter called "first direction"), a second cam surface 802*b* that presses the lever ratchet 7 when the cam portion 802 revolves in a second direction opposite to the first direction, and a stopper portion 802*c* positioned at an end of the second cam surface 802*b*. The switching portion 803 is a projecting portion provided on the outer circumferential surface of a cylindrical portion projecting along the support shaft 13 from the gear portion 801, and is provided for switching on and off the third switch SW3.

The cam gear 8 is arranged so that the first link shaft 604 is in a position overlapping a locus of the revolution of the cam portion 802 when the latch 4 is in the open position. Each of the first cam surface 802*a* and the second cam surface 802*b* of the cam portion 802 forms a spline surface.

The worm gear 9 transmits the power of the motor 10 at a reduced speed to the cam gear 8, and includes a worm 901 mounted on a rotary shaft 1001 of the motor 10, the worm wheel 902 meshing with the worm 901, and the reduction gear portion 903 provided so as to be integrated with the worm wheel 902.

While the latch 4 is in the open position, the cam gear 8 stands by in a first standby position in which the first cam surface 802*a* of the cam portion 802 first starts to press the first link shaft 604 when the cam gear 8 rotates in the first direction (counterclockwise direction) as illustrated in FIG. 4. At this time, all of the first, the second, and the third switches SW1, SW2, and SW3 are turned on. The first switch SW1 is turned on and off by a switch lever 19 rotatably supported on a support shaft (not illustrated) provided on the switch plate 3. When the latch 4 is in the open position, one end 19*a* of the switch lever 19 abuts on a first projecting portion 4*f* of the latch 4, and the other end 19*b* thereof presses the plunger of the first switch SW1. The switch lever 19 is urged counterclockwise in FIG. 4 by a coil spring 20. The second switch SW2 is switched by a switching portion 5*c* of the ratchet 5. When the latch 4 is in the open position, the switching portion 5*c* of the ratchet 5 presses the plunger of the second switch SW2. The third switch SW3 is switched by the switching portion 803 of the cam gear 8. When the latch 4 is in the open position, the switching portion 803 of the cam gear 8 presses the plunger of the third switch SW3. The switching portion 803 of the cam gear 8 is configured to press the plunger of the third switch SW3 immediately before the cam portion 802 revolving in the first direction reaches the position illustrated in FIG. 4.

Closing the back door while the latch 4 is in the open position causes the striker S to enter the striker entry grooves 1*a* and 2*a* and to press the pressure receiving portion 4*c* of the latch 4. The latch 4, receiving the pressing load from the striker S, rotates counterclockwise in FIG. 4, and moves toward the half-latch position.

Figure 6:
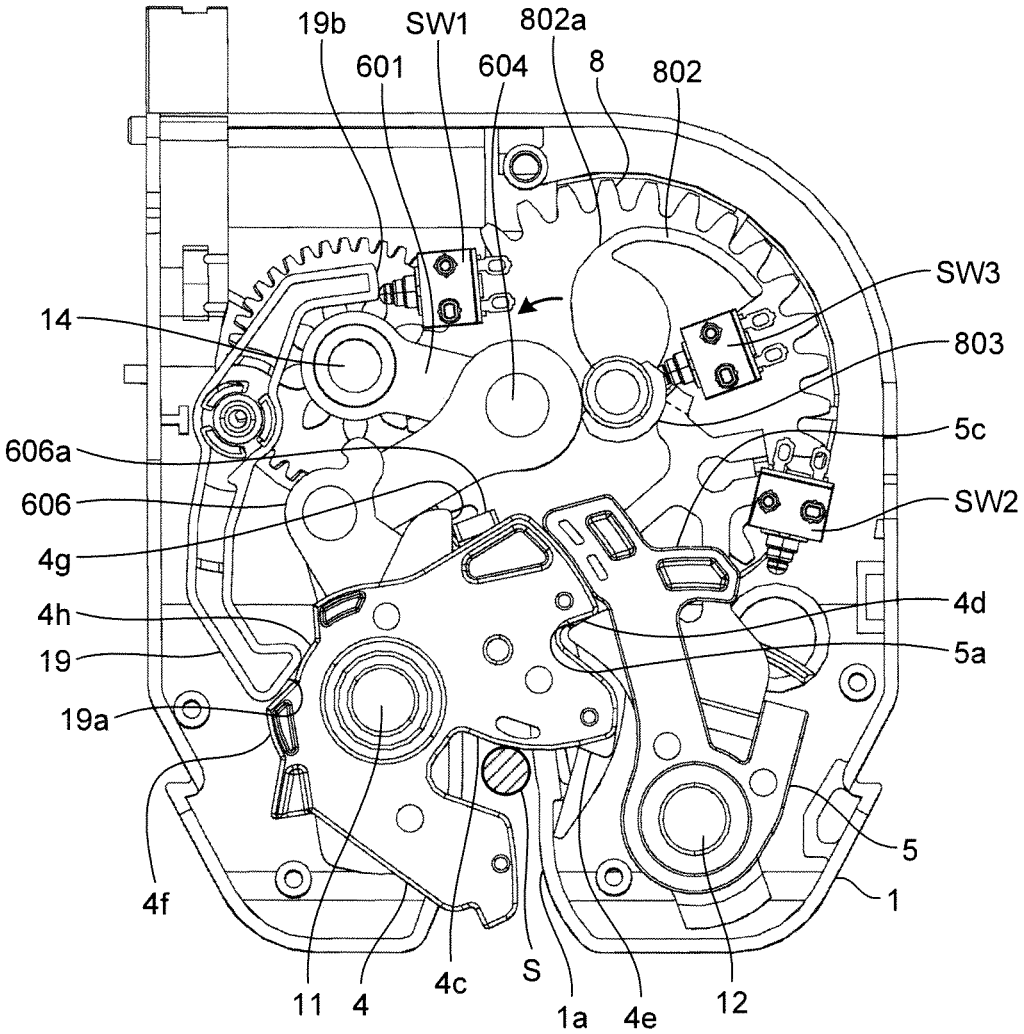
FIG. 6 is a view illustrating the internal configuration of the door latch device when a latch has moved from an open position into a half-latch position.
Figure 7:
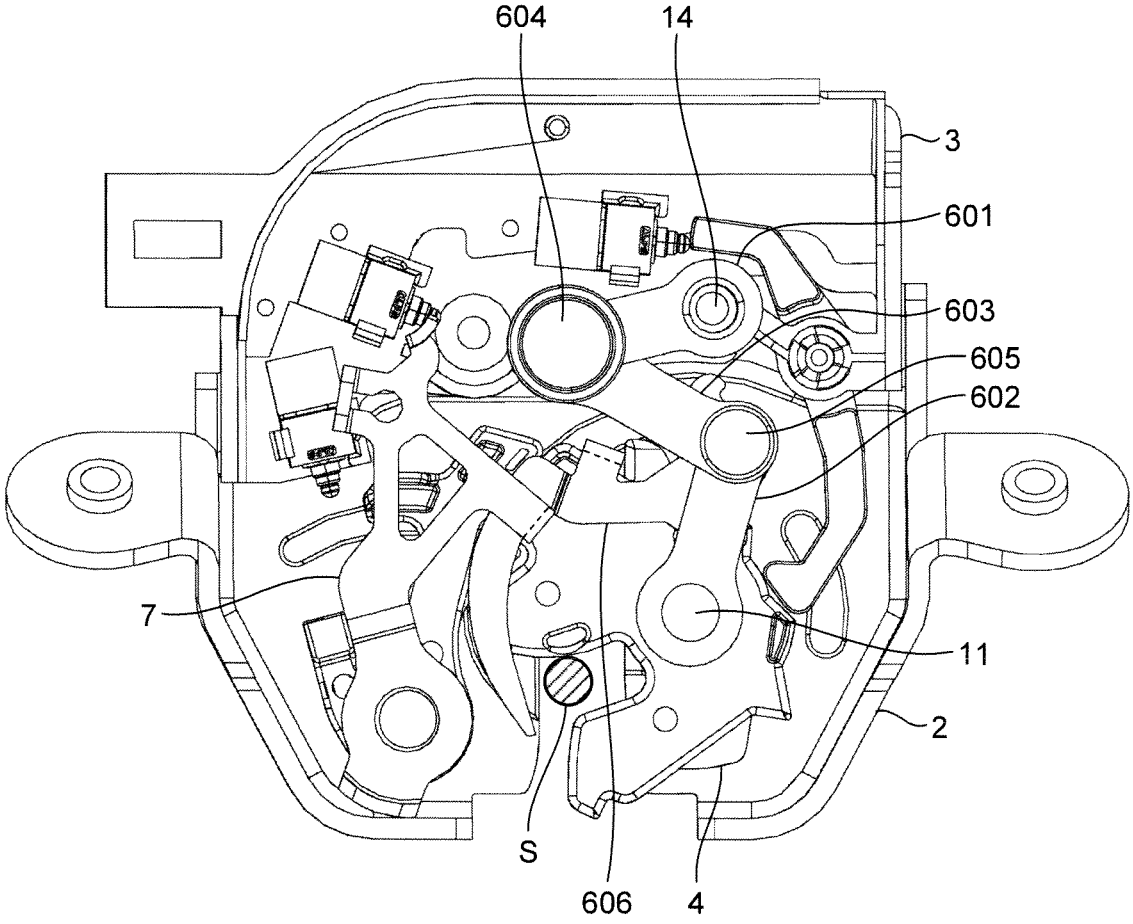
FIG. 7 is a view, as viewed from the backside, of the internal configuration illustrated in FIG. 6.
Figure 8:
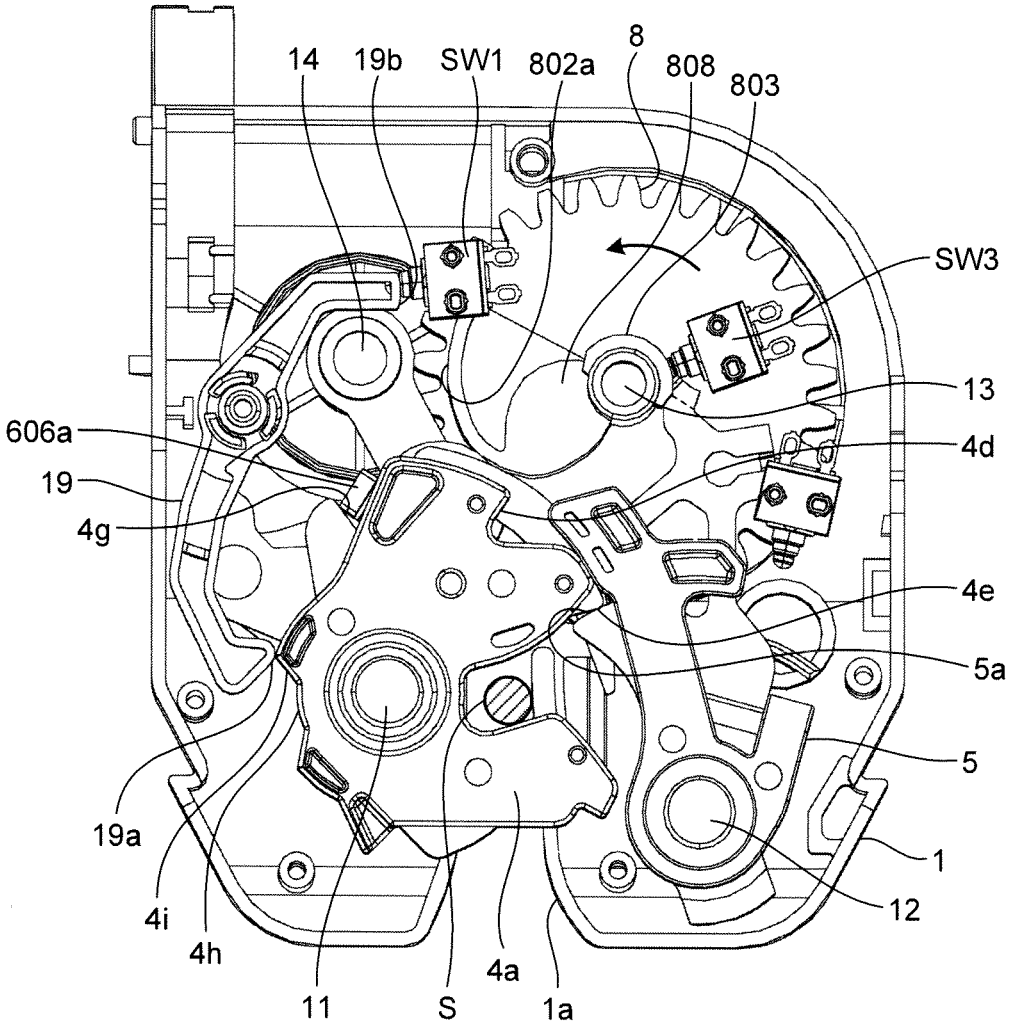
FIG. 8 is a view illustrating the internal configuration of the door latch device when the latch has moved into a full-latch position.
Figure 9:
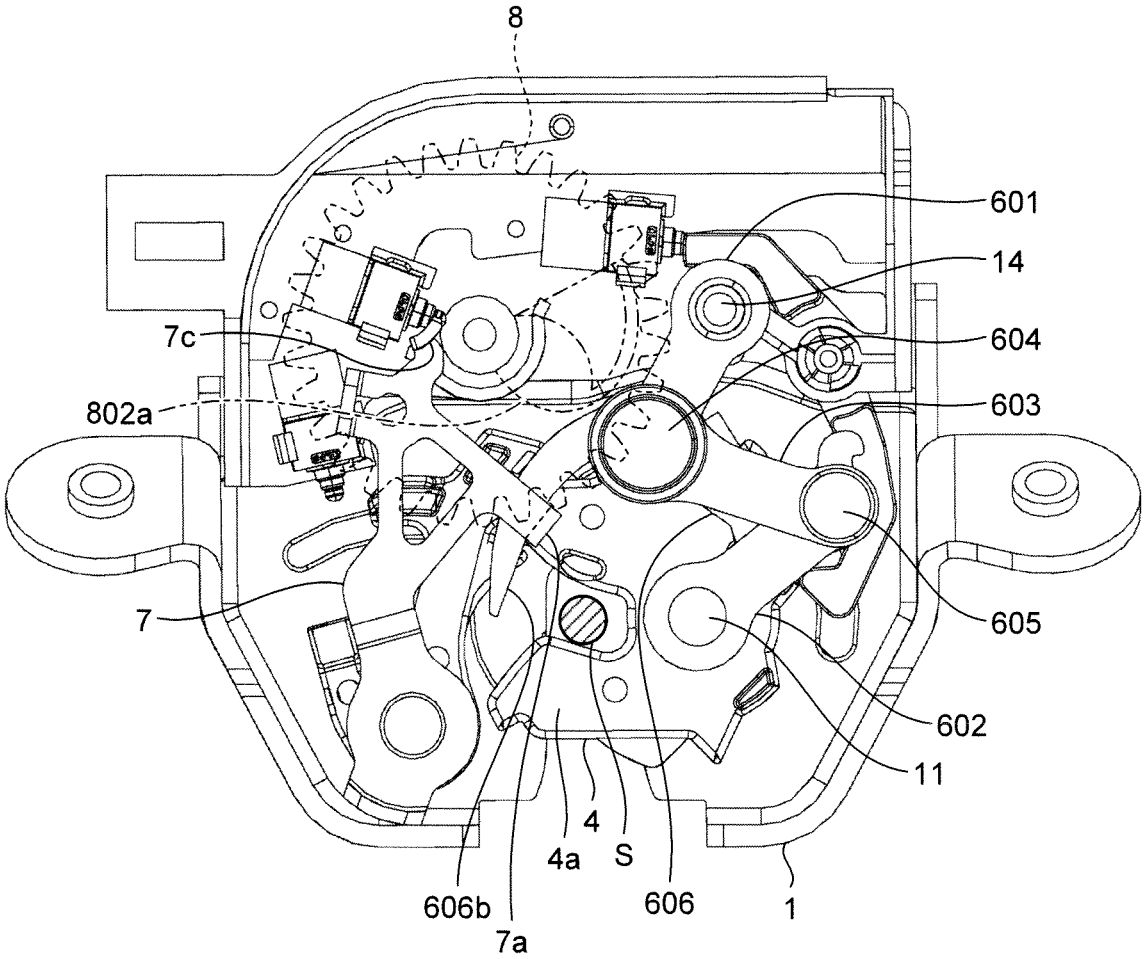
FIG. 9 is a view, as viewed from the backside, of the internal configuration illustrated in FIG. 8.
Figure 10:
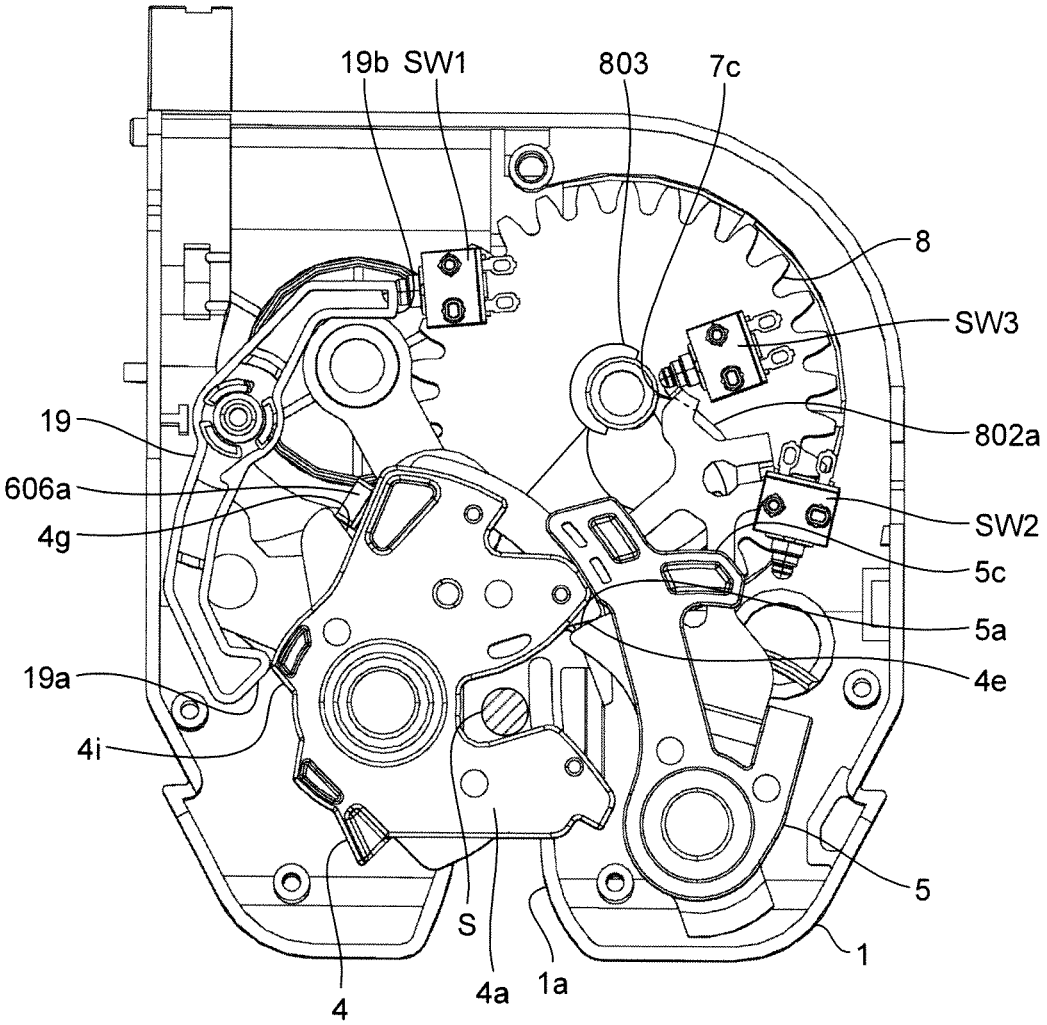
FIG. 10 is a view illustrating the internal configuration of the door latch device after an operation of retracting the latch into the full-latch position is completed.
Figure 11:
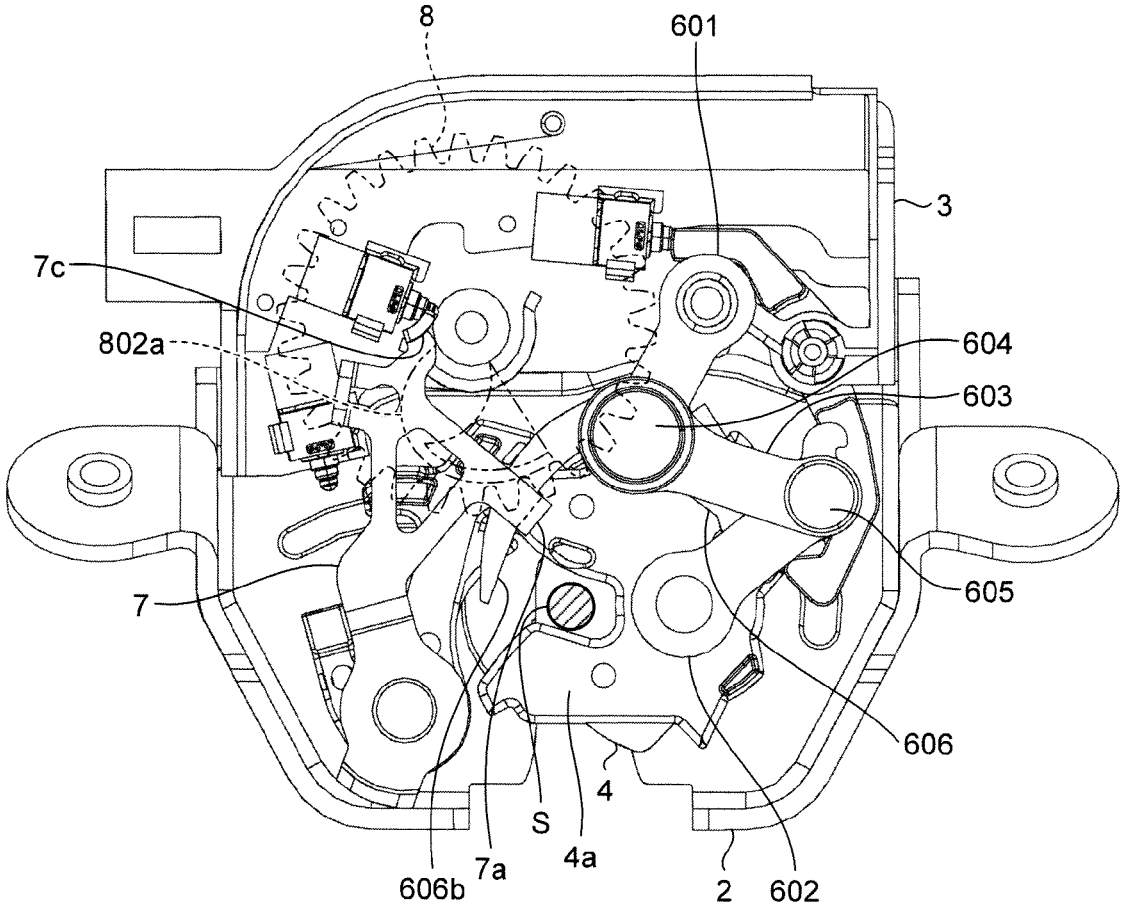
FIG. 11 is a view, as viewed from the backside, of the internal configuration illustrated in FIG. 10.

FIG. 6 is a view illustrating the internal configuration of the door latch device when the latch has moved from the open position into the half-latch position. FIG. 7 is a view, as viewed from the backside, of the internal configuration illustrated in FIG. 6. FIG. 8 is a view illustrating the internal configuration of the door latch device when the latch has moved into the full-latch position. FIG. 9 is a view, as viewed from the backside, of the internal configuration illustrated in FIG. 8. FIG. 10 is a view illustrating the internal configuration of the door latch device after an operation of retracting the latch into the full-latch position is completed. FIG. 11 is a view, as viewed from the backside, of the internal configuration illustrated in FIG. 10. FIGS. 6, 8, and 10 are views as viewed from the same direction as that of FIG. 4. FIGS. 7, 9, and 11 are views as viewed from the same direction as that of FIG. 3.

In the course of the movement of the latch 4 from the open position into the half-latch position, the position on which the end 19*a* of the switch lever 19 abuts changes from the first projecting portion 4*f* to a recessed portion 4*h*. The distance from the latch shaft 11 is smaller to the recessed portion 4*h* than to the first projecting portion 4*f*, so that the switch lever 19 rotates counterclockwise in FIG. 6. This separates the other end 19*b* of the switch lever 19 from the plunger of the first switch SW1, turning the first switch SW1 from on to off. When the latch 4 comes close to the half-latch position, a projecting portion (not illustrated) adjacent to the retraction engagement portion 4*g* of the latch 4 presses the retraction portion 606*a* of the retraction lever 606, and rotates the retraction lever 606 about the second link shaft 605. At this time, the retraction lever 606 rotates in the direction opposite to the direction of urging by the coil spring 17.

Then, arrival of the latch 4 in the half-latch position engages the half-latch latching portion 4*d* of the latch 4 with the latch engagement portion 5*a* of the ratchet 5, and the retraction portion 606*a* of the retraction lever 606 with the retraction engagement portion 4*g* of the latch 4, as illustrated in FIGS. 6 and 7. At this time, the ratchet 5 rotates counterclockwise in FIG. 6, and the switching portion 5*c* of the ratchet 5 comes apart from the plunger of the second switch SW2. This turns the second switch SW2 from on to off. When the arrival of the latch 4 in the half-latch position has turned off the first and the second switches SW1 and SW2 while the third switch SW3 is turned on, the control board operates the motor 10 so as to rotate the cam gear 8 in the first direction from the first standby position.

The rotation of the cam gear 8 in the first direction from the first standby position causes the first cam surface 802*a* of the cam portion 802 to press the first link shaft 604, thus causing the first link 601 to rotate clockwise in FIG. 6 about the support shaft 14. The rotation of the first link 601 operates the linkage mechanism 6 such that the second link 602 rotates counterclockwise in FIG. 6 about the latch shaft 11, that is, in the same direction as that in which the latch 4 rotates when moving from the half-latch position into the full-latch position. The rotation of the second link 602 rotates also the retraction lever 606, which is connected to the second link 602 via the second link shaft 605, counterclockwise in FIG. 6 about the latch shaft 11. At this time, the retraction lever 606 urged by the coil spring 17 rotates with the retraction portion 606*a* kept engaged with the retraction engagement portion 4*g* of the latch 4. This causes the retraction portion 606*a* of the retraction lever 606 to press the latch 4 via the retraction engagement portion 4*g* in the direction of the full-latch position, thus causing the latch 4 to move into the full-latch position.

The latch 4 has, on a side surface thereof slidingly contacting the ratchet 5, a section between the half-latch latching portion 4*d* and the full-latch latching portion 4*e* that has a distance from the latch shaft 11 increasing toward the full-latch latching portion 4*e*. This causes the ratchet 5 to rotate clockwise in FIG. 8, and thus causes the switching portion 5*c* of the ratchet 5 to press the plunger of the second switch SW2 in the course of the movement of the latch 4 from the half-latch position into the full-latch position. This turns the second switch SW2 from off to on. In the course of the movement of the latch 4 from the half-latch position into the full-latch position, the position on which the end 19*a* of the switch lever 19 abuts changes from the recessed portion 4*h* to a second projecting portion 4*i*. The distance from the latch shaft 11 is larger to the second projecting portion 4*i* than to the recessed portion 4*h*, so that the switch lever 19 rotates clockwise in FIG. 8. This causes the other end 19*b* of the switch lever 19 to press the plunger of the first switch SW1, turning the first switch SW1 from off to on.

Then, arrival of the latch 4 in the full-latch position engages the full-latch latching portion 4*e* of the latch 4 with the latch engagement portion 5*a* of the ratchet 5. At this time, the ratchet 5 rotates counterclockwise in FIG. 6, and the switching portion 5*c* of the ratchet 5 comes apart from the plunger of the second switch SW2. This turns the second switch SW2 from on to off.

Thereafter, the cam gear 8 further rotates in the first direction, and then, the first cam surface 802*a* of the cam portion 802 comes apart from the first link shaft 604 as illustrated in FIGS. 10 and 11. Then, the switching portion 803 of the cam gear 8 comes apart from the plunger of the third switch SW3, turning the third switch SW3 from on to off. When the arrival of the latch 4 in the full-latch position has turned on the first switch SW1, and turned off the second and the third switches SW2 and SW3, the control board stops the motor 10. This stops the cam gear 8, which, in turn, as illustrated in FIGS. 10 and 11, stands by in a second standby position in which the first cam surface 802*a* of the cam portion 802 first starts to press the cam sliding contact portion 7*c* of the lever ratchet 7 when the cam portion 802 rotates in the first direction. As a result, the striker S is constrained by the striker constraining portion 4*a* of the latch 4 lying across the striker entry grooves 1*a* and 2*a*, and the back door is held in the closed state.

Figure 12:
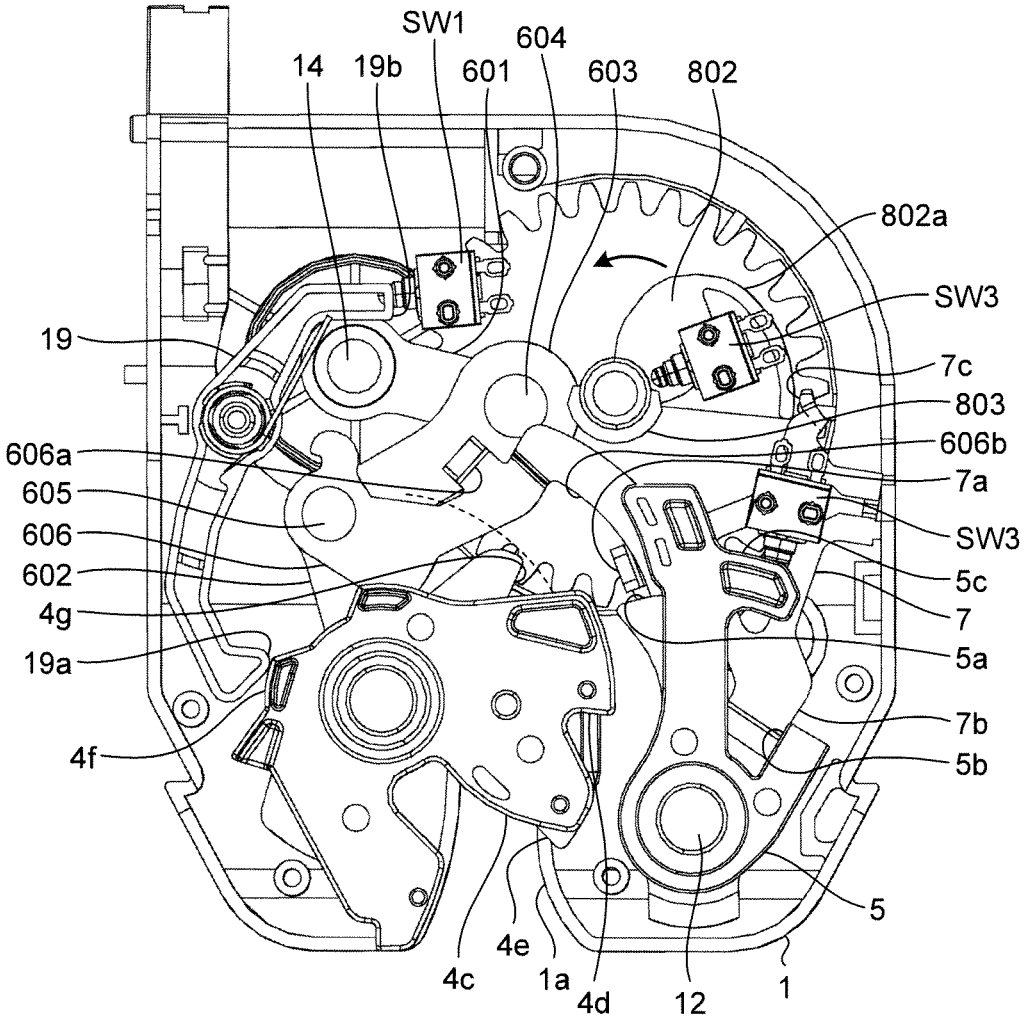
FIG. 12 is a view illustrating the internal configuration of the door latch device during a door opening operation.

FIG. 12 is a view illustrating the internal configuration of the door latch device during a door opening operation. FIG. 12 is a view as viewed from the same direction as that of FIG. 10.

While the latch 4 is held in the full-latch position and the cam gear 8 stands by in the second standby position, pressing a door opening button provided in a vehicle interior causes the control board to operate the motor 10 so as to rotate the cam gear 8 in the first direction. The rotation of the cam gear 8 in the first direction from the second standby position causes the first cam surface 802*a* of the cam portion 802 to press the cam sliding contact portion 7*c* of the lever ratchet 7, rotating the lever ratchet 7 clockwise in FIG. 10 about the ratchet shaft 12. At this time, the retraction lever pressing portion 7*a* of the lever ratchet 7 presses the cancel portion 606*b* of the retraction lever 606, rotating the retraction lever 606 counterclockwise in FIG. 12 about the second link shaft 605, as illustrated in FIG. 12. This rotates the retraction portion 606*a* of the retraction lever 606 about the second link shaft 605 in the direction moving away from the latch 4, thus causing the engagement between the retraction portion 606*a* and the retraction engagement portion 4*g* of the latch 4 to be released. At the same time as this, the ratchet pressing portion 7*b* of the lever ratchet 7 presses the pressure receiving portion 5*b* of the ratchet 5, moving the ratchet 5 into the disengagement position. This releases the engagement between the latch engagement portion 5*a* of the ratchet 5 and the full-latch latching portion 4*e* of the latch 4. As a result, the latch 4 moves into the open position, and the striker S is released, thus allowing the back door to be opened.

Thereafter, the cam gear 8 further rotates in the first direction, and then, the first cam surface 802*a* of the cam portion 802 comes apart from the cam sliding contact portion 7*c* of the lever ratchet 7. Then, the lever ratchet 7 rotates counterclockwise in FIG. 12 about the ratchet shaft 12, and returns into the position illustrated in FIG. 4. The return of the lever ratchet 7 into the position thereof illustrated in FIG. 4 returns the ratchet 5 into the position thereof illustrated in FIG. 4. The return of the lever ratchet 7 into the position thereof illustrated in FIG. 4 also returns the retraction lever 606 urged by the coil spring 17 into the position thereof illustrated in FIG. 4 while rotating the retraction lever 606 about the second link shaft 605. At this time, the second link shaft 605 rotates in the direction opposite to that of moving the latch 4 into the full-latch position. More specifically, the coil spring (linkage mechanism urging spring) 17 urges the first link 601, via the retraction lever 606 or the like, in the direction opposite to the direction in which the first link 601 moves when the latch 4 moves into the full-latch position. Therefore, the return of the lever ratchet 7 into the position thereof illustrated in FIG. 4 returns the linkage mechanism 6 into the position thereof illustrated in FIG. 4. In other words, the coil spring 17 urges not only the retraction lever 606 but the entire linkage mechanism 6.

The movement of the latch 4 from the full-latch position into the open position turns on the first and the second switches SW1 and SW2. Then, when the cam gear 8 rotates in the first direction, and the switching portion 803 presses the plunger of the third switch SW3, the third switch SW3 is turned from off to on. When the third switch SW3 is turned from off to on while the first and the second switches SW1 and SW2 are on in this manner, the control board stops the motor 10. This stops the cam gear 8 in the first standby position, thus returning the door latch device into the state illustrated in FIGS. 12 to 4.

When the door opening operation is performed by directly moving the lever ratchet 7 without rotating the cam gear 8 placed in the second standby position, the door latch device of the present embodiment can also release the engagement between the latch 4 and the ratchet 5, and the engagement between the latch 4 and the retraction lever 606. In that case, when the ratchet 5 moves into the disengagement position and the second switch SW2 is turned on, the control board operates the motor 10 so as to rotate the cam gear 8 in the first direction. Then, when the cam gear 8 reaches the first standby position illustrated in FIG. 4, and the third switch SW3 is turned on, the motor 10 stops and the cam gear 8 stops rotating.

Figure 13:
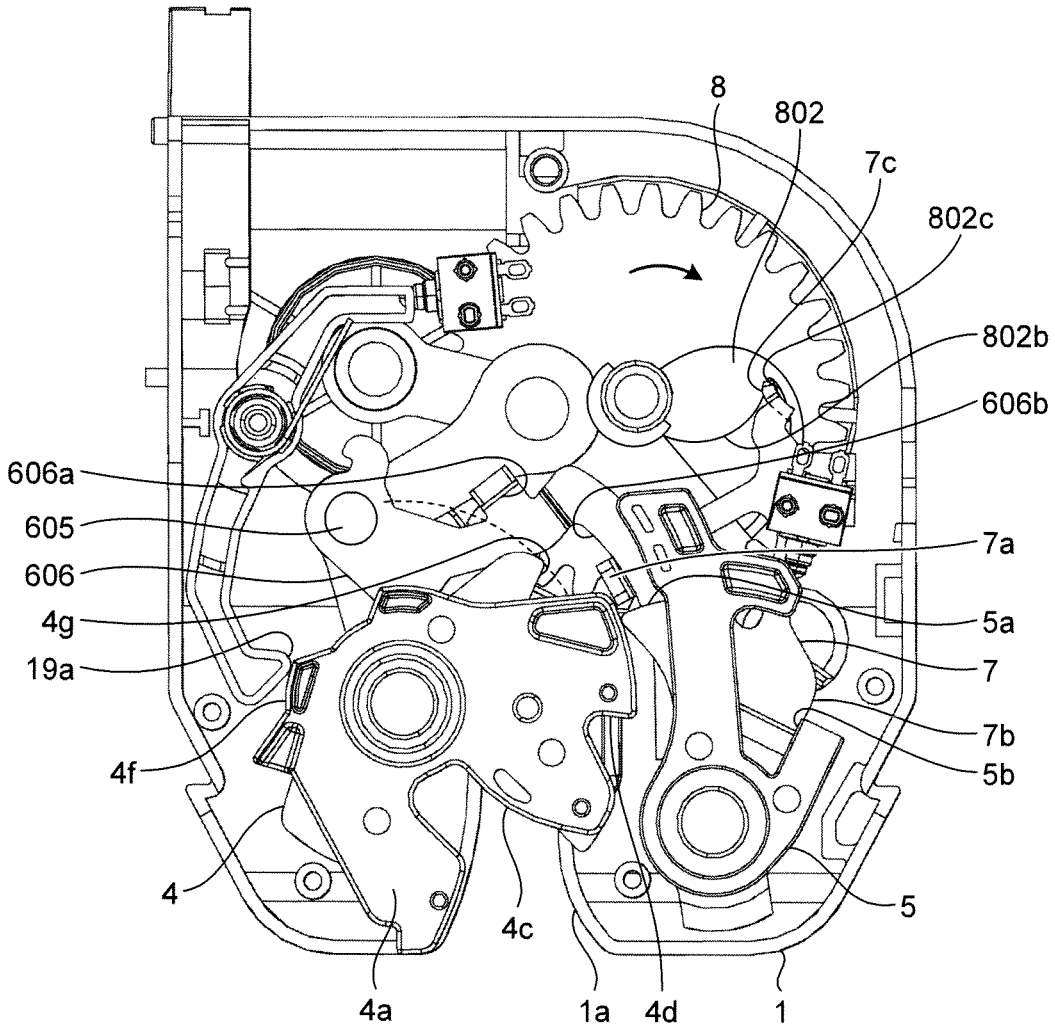
FIG. 13 is a view explaining another operation in the door latch device of the embodiment.

FIG. 13 is a view explaining another operation in the door latch device of the present embodiment. FIG. 13 is a view as viewed from the same direction as that of FIG. 8.

When the back door is closed, a situation could occur in which a foreign object such as clothes or baggage in the vehicle is pinched between the back door and the vehicle body, so that the latch 4 cannot be retracted into the full-latch position. The occurrence of such a situation causes the cam gear 8 to abnormally stop in the course of moving the latch 4 into the full-latch position, leading to an incomplete closed-door state in which the latch 4 is held between the half-latch position and the full-latch position.

When the cam gear 8 abnormally stops in the course of moving the latch 4 into the full-latch position, the door latch device of the present embodiment reverses the rotation of the motor 10 to rotate the cam gear 8 in the second direction. Rotating the cam gear 8 in the second direction, and thus separating the first cam surface 802*a* of the cam portion 802 from the first link shaft 604 holds the latch 4 in the half-latch position. Rotating further the cam gear 8 in the second direction from that state causes the second cam surface 802*b* provided on the cam portion 802 to press the cam sliding contact portion 7*c* of the lever ratchet 7, as illustrated in FIG. 13. Thus, the lever ratchet 7 and the ratchet 5 rotate clockwise in FIG. 13. This releases the engagement between the latch 4 and the ratchet 5, and the engagement between the latch 4 and the retraction portion 606*a* of the retraction lever 606, thus moving the latch 4 into the open position.

When the cam sliding contact portion 7*c* of the lever ratchet 7 reaches the end of the second cam surface 802*b*, the cam sliding contact portion 7*c* abuts on the stopper portion 802*c* of the cam portion 802 and restricts the rotation of the cam gear 8 in the second direction. The restriction of the rotation of the cam gear 8 reverses again the rotation of the motor 10 to rotate the cam gear 8 in the first direction. Then, when the cam gear 8 reaches the first standby position illustrated in FIG. 4, the motor 10 stops and the cam gear 8 stops rotating. This allows the back door to be quickly opened and closed again when the situation has occurred in which the latch 4 is placed in the incomplete closed-door state of being held between the half-latch position and the full-latch position.

As illustrated in FIG. 5, in the door latch device of the present embodiment, the intermediate link 603 of the linkage mechanism 6 intersects the first plane L1 including the support shaft 14 and the latch shaft 11. An occupied area of the linkage mechanism 6 as described above is obtained as a sum of an area of a substantially triangular shape lying on the first area side and an area of a substantially triangular shape lying on the second area side. If, instead of the above, the first link 601, the second link 602, and the intermediate link 603 are arranged on the second area side without changing the lengths of the first link 601, the second link 602, and the intermediate link 603, and the moving range of the second link shaft 605, the occupied area of the linkage mechanism takes a substantially quadrangular shape and is larger than the occupied area of the linkage mechanism 6 of the present embodiment. In other words, the linkage mechanism 6 of the present embodiment can reduce the occupied area of the linkage mechanism 6 without changing the lengths of the first link 601, the second link 602, and the intermediate link 603, and the moving range of the second link 602.

In the linkage mechanism 6 of the present embodiment, the first link 601, the second link 602, and the intermediate link 603 are arranged in a Z-shape. This arrangement can reduce the distance between the shaft center P1 of the support shaft (fixed shaft) 14 and the shaft center P2 of the latch shaft 11 while ensuring the amount of movement of the second link shaft 605 necessary for moving the latch 4 from the half-latch position into the full-latch position. In addition, by arranging the first link shaft 604 receiving the power from the cam gear 8 (driving member) in the area on the side including the ratchet 5 with respect to the first plane L1 serving as the boundary, the cam gear 8 can be arranged on the ratchet 5 side of the linkage mechanism 6. This can reduce the dimension in the depth direction (advancing/retreating direction of the striker S) of the door latch device required for arranging the linkage mechanism 6 and the cam gear 8, and thus can reduce the size of the door latch device.

In the door latch device of the present embodiment, the first link shaft 604 and the second link shaft 605 move between the second plane L2 that passes through the shaft center P1 of the support shaft 14 and is orthogonal to the first plane L1, and the third plane L3 that passes through the shaft center P2 of the latch shaft 11 and is orthogonal to the first plane L1. As a result, a dimension in the direction of a line segment connecting the shaft center P1 of the support shaft 14 and the shaft center P2 of the latch shaft 11 serves as the distance between the shaft center P1 of the support shaft 14 and the shaft center P2 of the latch shaft 11, so that the dimension in the depth direction of the door latch device can be further reduced.

In the door latch device of the present embodiment, the cam portion 802 revolves about the support shaft 13, and the first link shaft 604 is positioned within the locus of the revolution of the cam portion 802 when the latch 4 is in the open position. This allows the support shaft (revolution shaft) 13 supporting the cam gear 8 to be arranged near the first link 601, and can prevent the door latch device from increasing in size in the width direction (direction orthogonal to the depth direction).

The lever ratchet 7 rotatably supported on the ratchet shaft 12 and having the ratchet pressing portion 7*b* and the cam sliding contact portion 7*c* is arranged in the area on the side including the ratchet 5 with respect to the first plane L1 serving as the boundary. Thus, the cam portion 802 operating the linkage mechanism 6 can be used to move the ratchet 5 into the disengagement position. This allows the engagement between the latch 4 and the ratchet 5 to be released by the power from the motor 10, and can simplify the configuration for releasing the engagement.

The retraction lever 606 moving the latch 4 from the half-latch position into the full-latch position is rotatably connected to the second link shaft 605, and extends from the second link shaft 605 into the first area including the ratchet 5, in which the retraction portion 606*a* and the cancel portion 606*b* are provided on the retraction lever 606. The retraction lever 606 is urged by the coil spring 17 so that the direction of urging the rotation thereof about the second link shaft 605 is the same as the direction of urging the rotation of the latch 4 about the latch shaft 11. The retraction portion 606*a* of the retraction lever 606 is placed in the position that is moved closer to the latch shaft 11 by the rotation of the retraction lever 606 in the urged direction thereof. This allows the engagement and disengagement between the retraction portion 606*a* of the retraction lever 606 and the retraction engagement portion 4*g* of the latch 4 to be achieved by rotating the retraction lever 606 about the second link shaft 605. The cancel portion 606*b* of the retraction lever 606 is in engagement with the retraction lever pressing portion 7*a* of the lever ratchet 7, and, when the lever ratchet 7 moves the ratchet 5 into the disengagement position, the retraction lever pressing portion 7*a* presses the cancel portion 606*b* in the direction opposite to the direction of urging the retraction lever 606. This causes the retraction portion 606*a* of the retraction lever 606 to come apart from the retraction engagement portion 4*g* of the latch 4. This allows the lever ratchet 7 releasing the engagement between the latch 4 and the ratchet 5 to release also the engagement between the latch 4 and the retraction lever 606. This, in turn, can simplify the configuration for releasing the engagement between the latch 4 and the retraction lever 606, and can prevent the door latch device from increasing in size.

Further, the retraction lever 606 rotates together with the second link shaft 605 about the latch shaft 11 during the operation of the linkage mechanism 6. At that time, the retraction portion 606*a* of the retraction lever 606 in engagement with the retraction engagement portion 4*g* moves along the direction of movement of the latch 4 (retraction engagement portion 4*g*). This allows the latch 4 to be moved into the full-latch position by efficiently moving the retraction lever 606 during the operation of the linkage mechanism 6.

The cam portion 802 of the cam gear 8 can make a circle when revolving in the first direction, and while making one circle in the first direction, the first cam surface 802*a* presses individually once each of the first link shaft 604 and the cam sliding contact portion 7*c* of the lever ratchet 7. Therefore, by stopping the rotation of the cam gear 8 and making it stand by when the latch 4 has moved into the full-latch position and when the latch 4 has moved into the open position, the revolution of the cam gear 8 in the first direction can achieve the operation of moving the latch 4 from the half-latch position into the full-latch position, and the operation of moving the latch 4 from the full-latch position into the open position. The cam portion 802 is provided with the second cam surface 802*b* that can release the engagement between the latch 4 and the ratchet 5, and the engagement between the latch 4 and the retraction lever 606, via the lever ratchet 7 when the cam portions 802 revolves in the second direction. In addition, the end of the second cam surface 802*b* is provided with the stopper portion 802*c* that restricts the revolution of the cam portion 802 in the second direction in the state in which the second cam surface 802*b* presses the cam sliding contact portion 7*c* of the lever ratchet 7. This allows the latch 4 to be quickly returned into the open position when the cam gear 8 abnormally stops in the course of moving the latch 4 from the half-latch position into the full-latch position. The restriction of the revolution of the cam portion 802 in the second direction causes the cam portion 802 to revolve again in the first direction and stop in the first standby position. This allows the back door to be quickly opened and closed again when the latch 4 is placed in the incomplete closed-door state of being held between the half-latch position and the full-latch position.

The door latch device of the present embodiment connects the retraction lever 606 to the second link shaft 605, and engages the retraction portion 606*a* of the retraction lever 606 with the retraction engagement portion 4*g* of the latch 4 to move the latch 4 into the full-latch position. However, the method for moving the latch 4 into the full-latch position is not limited to the method using the retraction lever 606, but may be, for example, a method in which the second link 602 or the second link shaft 605 directly engages with the latch 4.

The first link shaft 604 of the linkage mechanism 6 and the cam sliding contact portion 7*c* of the lever ratchet 7 receiving the pressing load from the cam portion 802 only need to be arranged so as to be capable of individually performing the operation of moving the latch 4 from the half-latch position into the full-latch position, and the operation of releasing the engagement between the latch 4 and the ratchet 5. Specifically, the first link shaft 604 of the linkage mechanism 6 and the cam sliding contact portion 7*c* of the lever ratchet 7 are not limited to be arranged in the positional relation exemplified in the present embodiment, but only need to be arranged in a positional relation in which the first link shaft 604 and the cam sliding contact portion 7*c* of the lever ratchet 7 can be individually pressed when the cam portion 802 revolves in the first direction, and the cam sliding contact portion 7*c* can be pressed when the cam portion 802 revolves in the second direction. Therefore, the first link shaft 604 of the linkage mechanism 6 and the cam sliding contact portion 7*c* of the lever ratchet 7 can be arranged, for example, in the shaft center direction of the support shaft 13 so that a region of the locus of the revolution of the cam portion 802 overlapped by the first link shaft 604 overlaps a region of the locus of the revolution of the cam portion 802 overlapped by the cam sliding contact portion 7*c*. In that case, the first cam surface 802*a* of the cam portion 802 is divided into two in the shaft center direction of the support shaft 13, and one cam surface is treated as a retraction cam surface that presses the first link shaft 604 while the other cam surface is treated as a release cam surface that presses the cam sliding contact portion 7*c* of the lever ratchet 7. Displacing the apex of the retraction cam surface from the apex of the release cam surface by a predetermined angle about the shaft center of the support shaft 13 allows the first link shaft 604 and the cam sliding contact portion 7*c* to be individually pressed when the cam portion 802 revolves in the first direction. Further, providing the second cam surface 802*b* in a position corresponding to the release cam surface in the first cam surface 802*a* of the cam portion 802 allows the latch 4 to be promptly returned into the open position by revolving the cam portion 802 in the second direction when the cam gear 8 abnormally stops in the course of moving the latch 4 from the half-latch position into the full-latch position.

In the present embodiment, when the cam gear 8 rotates in the second direction, the rotation of the cam gear 8 is restricted by the abutment between the stopper portion 802*c* positioned at the end of the second cam surface 802*b* and the cam sliding contact portion 7*c* of the lever ratchet 7. However, without providing the stopper portion 802*c*, the cam gear 8 may be moved into the second standby position, and then may be rotated again in the first direction to be returned into the first standby position.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A door latch device comprising:

a base plate that has a portion defining a striker entry groove configured to be entered by a striker;

a latch that is rotatably supported by a latch shaft provided on the base plate and configured to move between a full-latch position in which the latch constrains the striker by engagement with the striker in the striker entry groove, and an open position in which the latch does not constrain the striker;

a ratchet that is rotatably supported by a ratchet shaft provided on the base plate and configured to move between an engagement position in which the ratchet engages with the latch so as to hold the latch in the full-latch position, and a disengagement position in which the ratchet does not engage the latch; and a linkage mechanism that is operated by power from a driving member and configured to move the latch to the full-latch position from a half-latch position lying between the open position and the full-latch position, wherein the linkage mechanism comprises a first link that is rotatably supported a fixed shaft provided on the base plate, a second link that is rotatably supported by the latch shaft, and an intermediate link that is rotatably connected to the first link by a first link shaft and rotatably connected to the second link by a second link shaft, and the linkage mechanism is configured such that, while the linkage mechanism moves the latch from the half-latch position into the full-latch position, the first link shaft moves only within an area on one side of a boundary defined by the fixed shaft and the latch shaft, and the second link shaft moves only within an area on another side of the boundary.

2. The door latch device according to claim 1, wherein the driving member comprises a cam portion that revolves about a revolution shaft provided on the base plate, and the linkage mechanism and the driving member are arranged so that the first link shaft is in a position overlapping a locus of a revolution of the cam portion when the latch is in the open position, and, when the cam portion revolves, the cam portion presses the first link shaft to move the first link; and further comprising:

a linkage mechanism urging spring configured to urge the first link in a direction opposite to a direction in which the first link moves when the latch is moved from the half-latch position into the full-latch position.

3. The door latch device according to claim 2, further comprising a lever ratchet that is rotatably supported by the ratchet shaft, and engages with the ratchet so as to move the ratchet into the disengagement position, wherein the lever ratchet includes a cam sliding contact portion that is slidingly contactable with the cam portion, and the cam sliding contact portion of the lever ratchet is arranged in a position in which the cam sliding contact portion overlaps the locus of the revolution of the cam portion when the cam portion is apart from the cam sliding contact portion, and receives a pressing load from the cam portion when the cam portion slidingly contacts the cam sliding contact portion, wherein the pressing load from the cam portion causes the lever ratchet to rotate in a direction about the ratchet shaft so as to move the ratchet into the disengagement position; and a lever ratchet urging spring configured to urge the lever ratchet in a direction opposite to the direction in which the lever ratchet is rotated by the pressing load from the cam portion.

4. The door latch device according to claim 3, wherein the linkage mechanism comprises a retraction lever that is rotatably connected to the second link shaft; and the retraction lever includes a retraction portion that engages with the latch, so as to be capable of pressing the latch toward the full-latch position, after the latch has moved from the open position into the half-latch position.

5. The door latch device according to claim 4, wherein in the linkage mechanism, the area in which the first link shaft moves is the area on the one side of the boundary that includes the ratchet, the retraction lever intersects the boundary; and the lever ratchet includes a retraction lever pressing portion that engages with the retraction lever, and rotates, when the lever ratchet receives the pressing load from the cam portion, the retraction lever in the direction of releasing the engagement between the retraction portion of the retraction lever and the latch.

6. The door latch device according to claim 3, wherein the cam portion comprises:

a first cam surface that is capable of pressing individually the first link shaft and the cam sliding contact portion of the lever ratchet when the cam portion revolves in a first direction; and a second cam surface that is capable of pressing the cam sliding contact portion of the lever ratchet when the cam portion revolves in a second direction.

* * * * *